United States Patent [19]

Lawlor et al.

[11] Patent Number: 4,734,539

[45] Date of Patent: Mar. 29, 1988

[54] NAPHTHA ISOMERIZATION USING A MEDIUM PORE ZEOLITE CATALYST

[75] Inventors: Lawrence J. Lawlor, Camlachie; William J. Murphy, Brights Grove, both of Canada

[73] Assignee: Exxon Research and Engineering Company, Florham Park, N.J.

[21] Appl. No.: 924,517

[22] Filed: Oct. 29, 1986

[51] Int. Cl.[4] ..... C07C 5/13

[52] U.S. Cl. ..... 585/739; 208/135; 208/136; 208/138

[58] Field of Search ..... 585/739; 208/135

[56] References Cited

U.S. PATENT DOCUMENTS

| | | | |
|---|---|---|---|
| 3,749,754 | 7/1973 | Eberly | 585/739 |
| 3,751,502 | 8/1973 | Hayes | 585/739 |
| 4,162,212 | 7/1979 | Miller | 585/739 |
| 4,347,394 | 8/1982 | Detz et al. | 585/417 |
| 4,374,296 | 2/1983 | Haag et al. | 585/739 |

*Primary Examiner*—Curtis R. Davis

*Attorney, Agent, or Firm*—Joseph J. Allocca

[57] ABSTRACT

Naphtha is isomerized using a medium-pore zeolite catalyst.

Isomerization is accomplished by contacting the hydrocarbon with the medium-pore zeolite catalyst at a temperature in the range 200° to 400° C., preferably, at a space velocity of 0.05 to 75 v/v/hr, preferably, at a pressure at 14.7 to 1500 psig.

The medium zeolite catalyst employed has a silica to alumina ratio in the range of about 5 to >30, preferably 10–20, more preferably 12–17 and a pore size of about 5.5 to 6.8 Å. The preferred medium pore zeolite is a zeolite of the offretite type. The zeolite preferably has associated with it a hydrogenation component which is typically a Group VIII metal, oxide or sulphide, or mixtures thereof, preferably platinum or palladium. The preferred offretite type zeolite may be any of the readily available commercial materials and may have their $SiO_2/Al_2O_3$ ratios enhanced by typical methods such as H-EDTA or mineral acid leaching, or similarly may be any of the specialty offretites and offretite type zeolites now being described in the patent or general literature.

8 Claims, 9 Drawing Figures

RONcl RATINGS OF EQUILIBRIUM FRACTIONS

HEATING/TIME PROFILE DURING ZEOLITE SYNTHESIS IN EXAMPLE 3

FEED: n-HEXANE

CONDITIONS: 300°C, 1.0 W/HR/W, 172KPa, 4:1 $H_2$/FEED

SYMBOLS: o SYNTHETIC OFFRETITE, Δ IOZ-6

ACTIVITY MAINTANCE OF CATALYST K

Conditions:300°C,100 psig,1.0 w/w/hr.,$H_2$:oil=4

$SiO_2/Al_2O_3$=16.5:1,$K_2O/Al_2O_3$=0.25:1,wt.% Pt

ACTIVITY MAINTAINANCE OF CATALYST L

Conditions: 280°C,100 psig,1.0 w/w/hr.,$H_2$:oil=4

$SiO_2/Al_2O_3$=16.5:1,$K_2O/Al_2O_3$=0.26:1,0.5 wt.% Pt

EFFECT OF CONTACT TIME

Catalyst L, $SiO_2/Al_2O_3$=16.5:1, $K_2O/Al_2O_3$=0.25:1, 0.5 wt.% Pt

Temperature: 280°C, Feed: n-Hexane

EFFECT OF SULPHUR (AS DITERTIARY-BUTYLSULPHIDE) ON ACTIVITY

Conditions: 280°C, 100 psig, 1.0 w/w/hr., $H_2$:oil=4

Catalyst L, $SiO_2/Al_2O_3$=16.5:1, $K_2O/Al_2O_3$=0.25:1, 0.5 wt.% Pt

EFFECT OF SULPHUR (AS DIMETHYLSULPHIDE) ON ACTIVITY

Conditions:280°C,100 psig,1.0 w/w/hr.,$H_2$:oil=4

Catalyst L, $SiO_2/Al_2O_3$=16.5:1, $K_2O/Al_2O_3$=0.25:1, 0.5 wt.% Pt

EFFECT OF SULPHUR (AS THIOPHENE) ON ACTIVITY

Conditions: 280°C, 100 psig, 1.0 w/w/hr., $H_2$:oil=4

Catalyst L, $SiO_2/Al_2O_3$=16.5:1, $K_2O/Al_2O_3$=0.25:1, 0.5 wt.% Pt

NAPHTHA ISOMERIZATION USING A MEDIUM PORE ZEOLITE CATALYST

BACKGROUND OF THE INVENTION

Processes for isomerization of paraffin components in naphtha to give gasoline blending components with high octane numbers require a catalyst with high activity and stability to take advantage of the relatively high equilibrium conversions at low temperature.

In the case of n-pentane isomerization, although neopentane is thermodynamically possible the only product observed is iso-pentane. Neopentane is not produced as a major product during isomerization, perhaps as a result of kinetic factor.

For n-hexane isomerization the yields of 2,3-dimethylbutane and the sum of the yields of 2-methylpentane and 3-methylpentane are relatively temperature independent. Therefore, when describing the activity of a naphtha isomerization catalyst a measure of activity for n-hexane isomerization is its ability to convert n-hexane to 2,2-dimethylbutane at a given temperature.

The octane numbers of the equilibrium fractions of both $C_5$, $C_6$ and mixtures of $C_5/C_6$ tend to increase linearly with decreasing temperature (FIG. 1). Given the fact that the research octane numbers of n-hexane and n-pentane are ~25 and ~62 respectively, substantial octane increases can be obtained via isomerization. The octane of a light naphtha can be increased by 10–12 RON (Research Octane Numbers) through single-pass operation (FIG. 1) and if the normal paraffin are separated from the isomerized product and recycled for further reaction an octane increase of 20 RON can be realized. In addition, the isomerization process has other advantages, e.g., it is a low temperature (200°–300° C.), low pressure (<500 psi) process.

Examples of zeolites used as light naphtha isomerization catalysts include faujasite (Zeolite Y), U.S. Pat. No. 3,236,904, and mordenite, U.S. Pat. No. 3,190,939.

Several studies comparing the activity and properties of mordenite and faujasite (e.g., zeolite Y) catalyst have been carried out. Gray and Cobb, *J. Catal.*, 36, 126 (1975) state that the active sites of mordenite are similar to their counterparts in faujasite. Despite similarities each catalyst has its own unique properties. For example, steric effects are more pronounced in mordenite since it has a slightly smaller pore size than zeolite Y (faujasite) and does not contain the large macropores of the faujasites (Yashima and Hara, *J. Catal.*, 27, 329 (1972)). Further, mordenite has an unidimensional pore system, whereas the faujasites have three dimensional pore systems.

DESCRIPTION OF THE INVENTION

The subject of the current invention is isomerization of naphtha using medium pore zeolites preferably the medium pore zeolites of the offretite family of zeolites as bases for naphtha isomerization catalysts.

As used herein, the term "naphtha feed" includes any heavy, medium or light naphtha, preferably light naphtha, more preferably light hydrocarbons, including linear or normal hydrocarbons having between 4 to 10 carbons which can also contain some minor quantities of other components such as minor quantities of aromatics.

Isomerization is accomplished by contacting the naphtha or light hydrocarbon feed stream with the medium pore zeolite catalyst at a temperature in the range of about 200° C. to 400° C., preferably about 200° C. to 350° C., most preferably about 250° C. to 310° C., at a space velocity in the range of about 0.05 to 75 v/v/hr., preferably 0.1 to 50 v/v/hr, most preferably 0.1 to 20 v/v/hr. The reaction pressure is in the range of about 1 atmosphere (14.7 psig) to 1,500 psig, preferably about 1 atmosphere (14.7 psig) to 700 psig, at a hydrogen ($H_2$) to feed ratio (mole/mole basis) in the range of about 1:1 to 20:1, preferably 3:1 to 7:1. Note that hereafter in the text where hydrogen to feed ratio is quoted it is understood to be on a mole/mole basis.

The naphtha feed generally contains saturated and olefinic hydrocarbon of from $C_4$ to $C_{10}$ and may be either normal-linear hydrocarbons, branched hydrocarbons, or, more typically, a mixture of both. The naphtha has a boiling range of up to 380° F., preferably up to 250° F., most preferably 80° F. to 200° F.

The catalyst is sensitive to the presence of sulfur in the feed. If a continuous regeneration process is utilized it is believed that no special precautions need be taken as to the feed sulfur content. In general, however, due to the detrimental effect of sulfur in the feed, it is preferred that the sulfur content be on the order of less than 100 ppm. more preferably less than 25 ppm, most preferably less than 15 ppm in the feed sent to the isomerization unit.

The medium pore zeolite catalyst used in the current invention has a silica to alumina ratio in the range of about 5 to >30, preferably about 10 to 20, more preferably about 12 to 17 and has a pore size of about 5.5 to 6.8 Å. The offretite type zeolite can be either synthesized having the having the desired silica to alumina ratio, or an as synthesized low silica/alumina ratio offretite can be leached using H-EDTA or mineral acid to yield the higher ratio material which functions in the present invention. Regardless of the way in which the offretite having the desired silica/alumina ratio is produced, the zeolite catalysts of the offretite family of zeolites is a medium pore material, i.e., possessing pores of about 5.5 to 6.8 Å. The offretite-type zeolite material may have a particle size ranging from about 10 microns to as low as <0.1 microns. In contrast to both mordenite and faujasite, it has a much smaller pore size than both, a unidemensional pore system accessible to hydrocarbon feed molecules, but a secondary pore system accessible to hydrogen.

Synthetic offretite is a well-defined zeolite, with a known x-ray diffraction pattern and a proposed crystal structure. The structure is stable on dehydration, and the dehydrated structure has pores sufficiently large to admit hydrocarbons, such as normal paraffins, and, thus, behaves as a "molecular sieve". The synthetic offretite useful for the present invention is not to be confused with erionite, a closely related mineral, or with zeolite T, which is an intergrowth of erionite and offretite.

Synthetic offretite and offretite type zeolites useful in the present invention may be prepared by the methods described in Canadian Pat. No. 934,130, in U.S. Pat. No. 3,578,398, U.S. Pat. No. 4,086,186, and G.B. Pat. No. 1,413,470 (describing a synthetic near offretite identified as AG2). Tetramethylammonium-Rb-offretite, described in "Synthesis and Characterization of a New Zeolite of the Offretite Type", Occelli and Perrota, Symposium on Advances in Zeolite Chemistry, Div. of Petroleum Chemistry, Am. Chem. Soc., Las Vegas Meeting, Mar. 28–Apr. 2, 1982, page 452, is also considered useful in the current invention.

The offretite useful in this invention is a crystalline aluminosilicate, having a composition, in terms of mole ratios of oxides, as follows:

$$(1.1\pm0.4)M_{2/n}O.Al_2O_3.5\rightarrow30SiO_2.zH_2O$$

wherein M is a cation other than a mixture of sodium and potassium; n is the valence of said cation; and z is between 0 and 8, and having an x-ray powder diffraction pattern substantially the same as that shown in Table I below.

TABLE I

| 20 | d | Height* (Arbitrary Units) |
|---|---|---|
| 7.716 | 11.458 | 26.2 |
| 11.707 | 7.559 | 6.7 |
| 13.413 | 6.601 | 16.2 |
| 14.036 | 6.310 | 5.1 |
| 15.502 | 5.716 | 9.3 |
| 19.467 | 4.560 | 19.2 |
| 20.560 | 4.320 | 28.2 |
| 23.369 | 3.807 | 24.7 |
| 23.716 | 3.752 | 54.4 |
| 24.827 | 3.586 | 38.0 |
| 26.169 | 3.405 | 1.5 |
| 27.040 | 3.297 | 16.4 |
| 28.320 | 3.151 | 20.0 |
| 30.604 | 2.921 | 6.8 |
| 31.431 | 2.846 | 63.1 |
| 33.529 | 2.673 | 16.1 |
| 34.196 | 2.622 | 1.3 |
| 35.707 | 2.515 | 3.7 |
| 36.231 | 2.479 | 14.2 |
| 38.267 | 2.352 | 1.7 |
| 39.458 | 2.352 | 3.9 |
| 41.040 | 2.199 | 7.7 |

*Diffractometer fitted with automatic divergence slit.

The zeolite has the ability to sorb cyclohexane in amounts at least about 1.5 percent by weight at 25° C. and 20 mmHg. It can also sorb n-hexane to at least about 1.5 weight percent n-hexane.

The composition in its as-synthesized form typically can be expressed in terms of mole ratios of oxides as follows:

$$(1.1\pm0.4)[xR_2O.(1-x)M_{2/m}O].Al_2O_3.5-12SiO_2:z-H_2O$$

wherein n and z have the previously assigned significance; x is between 0.001 and 0.5; R is trimethylammonium or choline; and M is an alkali metal or mixtures of alkali metals or mixtures of alkali and alkaline earth metals. Particularly useful in this invention are potassium, sodium and rubidium.

The as-synthesized form of the composition can undergo ion exchange to exchange at least a portion of the original cations for other cations in which case the composition can be represented in terms of mole ratios of oxide as follows:

$$(1.1\pm0.4)M_{2/m}O.Al_2O_3.5-12SiO_2.zH_2O$$

wherein n and z have the previously assigned significance and M is selected from the group consisiting of tetramethylammonium, hydrogen, ammonium and metals other than the metals used during the synthesis. Preferably M is a cation other than an alkali metal cation. Particularly desirable metal cations are those which have catalytic activity in the form used. These include metals of Group II and Group VIII of the Period Table, cobalt, molybdenum, chromium, tungsten manganese platinum and palladium and mixtures thereof. Of the Group II metals zinc is preferred, especially in a form wherein some of the cation sites are occupied by a hydrogen ion. Where M in the zeolite is hydrogen or an ammonium species the zeolite may be activated by thermal treatment at a temperature of at least 700° F. to about 1,600° F.

A further member of the offretite family of zeolites useful in the present invention is T-IOZ-5 and may be prepared as described in co-pending application attorney docket number OP-2895, U.S. Ser. No. 866,305, filed May 23, 1986.

The T-IOZ-5 composition is characterized by a specific x-ray diffraction pattern (generally that shown in Table II) and the presence of transition metal(s) in the crystal lattice and can be further identified, in terms of mole ratios of oxides in the anhydrous state, as follows:

$$(0.3-2.5)R_2O.(0.3-2.5)M_{2/m}O.Z(0.02-1)Y_{2/z}O.Al_2O_3.XSiO_2$$

wherein R is a tetramethylammonium cation or choline cation; M is an alkali metal cation, preferably being potassium or a mixture of alkali metals containing potassium or a mixture of alkali metal cations and alkaline earth metal cations including potassium; X is at least , 5; Y is a transition element or combination of transition elements; Z is the valency of said transition element; and m is the valency of the alkali or alkaline earth element.

TABLE II

| 2 Times Theta | Relative* Intensity I/IO |
|---|---|
| 7.8 | 39.3 |
| 11.8 | 11.4 |
| 13.5 | 12.1 |
| 14.1 | 10.8 |
| 15.6 | 13.8 |
| 19.6 | 34.6 |
| 20.7 | 39.2 |
| 23.5 | 47.1 |
| 23.8 | 77.3 |
| 24.9 | 62.7 |
| 27.2 | 25.4 |
| 28.4 | 32.7 |
| 30.7 | 11.2 |
| 31.5 | 100.0 |
| 33.7 | 23.3 |
| 34.5 | 12.6 |
| 35.7 | 9.2 |
| 36.3 | 22.2 |

*Diffractometer fitted with automatic divergence slit.

A preferred formula of the synthesized form of the subject zeolite in terms of ratios of oxides and in the anhydrous state is as follows:

$$(0.3-2.5)R_2O.(0.4-2.5)M_{2/m}O.Z(0.02-1)Y_{2/z}O.Al_2O_3.(5-18)SiO_2$$

wherein R is a tetramethylammonium cation; M is potassium or a mixture of alkali metals, one of which is potassium; Y is a transition element or mixture of such elements, preferably iron; Z is the valency of said transition element; and m is the valency of the alkali or alkaline earth element.

The T-IOZ-5 zeolite material is utilized in naphtha isomerization after the iron or other transition element or mixture of such elements (Y in the above formula)

has been leached from the zeolite structure. Such leaching can be accomplished by using strong mineral acids (such as HCl) or materials such as EDTA-$H_4$, respectively, alternating refluxing the zeolite in the presence of such acid or EDTA-$H_4$, and calcining the zeolite.

The zeolites useful in this invention may be composited with a binder, such as alumina, silica, silica-alumina, silica-titania, silica-zirconia, or a clay, such as KAOLIN and mixtures thereof.

The zeolite is preferably used in intimate combination with a hydrogenating component selected from the group consisting of tungsten, vanadium, molybdenum, rhenium, nickel, cobalt, chromium, manganese, or a noble metal, such as platinum or palladium having a hydrogenation/dehydrogenation function metal, oxide or sulfide and mixtures thereof, preferably platinum, palladium and, mixtures thereof. Such component can be exchanged into the composition, impregnated therein or physically intimatley admixed therewith. Such component can be impregnated in or onto the zeolite, such as, for example, by, in the case of platinum, treating the zeolite with a platinum metal-containing ion. Thus, suitable platinum compounds include chloroplatinic acid, platinous chloride and various compounds containing the platinum amine complex. Metal loading may be between 0.01 to 10 weight percent, preferably 0.1 to 5.0 weight percent, most preferably 0,.2 to 2.5 weight percent.

The compounds of the useful platinum or other catalytically active metals can be divided into compounds in which the metal is present in the cation of the compound, and compounds in which it is present in the anion of the compound. Both types of compounds which contain the metal in the ionic state can be used. A solution in which platinum metals are in the form of a cation or cationic complex, e.g., $Pt(NH_2)_4Cl_2$, is particulalry useful.

Examples of the synthesis of the offretite family of zeolites which were used to illustrate the current invention are detailed below.

EXAMPLE A

Figure 1:
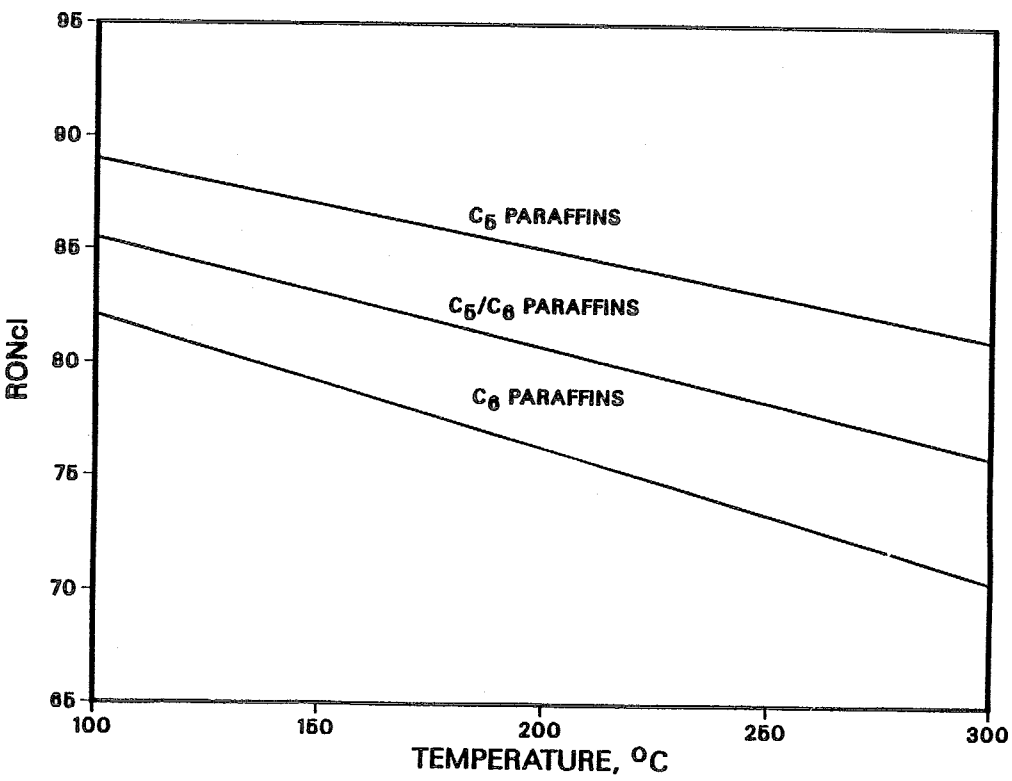
FIG. 1 relates to RON equilibrium fractions of $C_5$, $C_5/C_6$ and $C_6$ paraffins to isomerization temperature.

Synthetic offretite was a generally made from a parent gel of oxide composition as follows:

$SiO_2$: 20
$Al_2O_3$: 1
$(Me_4N)_2O$: 0.9
$K_2O$: 7.1
$Na_2O$: 0
$H_2O$: 431

The preparation was carried out in one tenth molar scale according to the following method:

90.8 grams of KOH (85%) were dissolved in 267 grams of water, 125.6 grams of aluminum hydroxide were added and the solution heated until the alumina dissolved. This was then cooled to room temperature before being added slowly with stirring (over a period of ten minutes) to 400 gram Ludox 30. This nucleation mixture was then allowed to age for a minimum of 3 days. 19.7 grams of tetramethylammonium chloride were dissolved in 200 grams of water and added slowly to the gel after the aging period. This parent gel was then placed in a 5 liter, 3-neck boiling flask and stirred under reflux until crystallization was completed. Crystallization was complete after ~2 days, after which the product crystals were washed 3 times in boiling water for 1 hour each washing, followed by filtration.

The x-ray analyses of the crystalline product proved to have the diffraction pattern substantially of TMA offretite as listed in Table I. Chemical analysis showed this material to have the following composition:

$$0.56K_2O.0.46TMA_2O.Al_2O_3.10.0SiO_2yH_2O$$

where y was not determined.

A scanning electron microscopy study of this product indicated the particle size to be about 1×0.5 microns "cigar" shaped particles. This is an agreement with the data published for "TMA offretite", T. E. Whyte, E. L. Wu, G. T. Kerr, and P. B. Venuto, *J. Catal.* 20 88 (1971); R. Aiello and R. M. Barrer, *J. Chem. Soc.* (A) 1470 (1970).

EXAMPLE B

Illustrating the preparation of tetramethylammonium iron, T-IOZ-5, (co-pending application attorney docket number OP-2895, U.S. Ser. No. 866,305) 90.8 grams potassium hydroxide (85 weight percent KOH), 15.6 grams alumina and 267 grams water were mixed and heated with stirring until the alumina dissolved and then cooled to room temperature. This was then added to 400 grams Ludox LS (being an aqueous ~30 percent by weight $SiO_2$ colloidal silica sol—E. I. Du Pont) slowly with stirring and the stirring continued until the gel as formed appeared homogeneous. A solution of 19.7 grams of tetramethylammonium chloride in 100 grams of water was then added slowly and with stirring. A slurry or solution of 36.9 grams ferrous ammonium sulphate in 100 grams water was added to the slurry. The synthesis gel composition in terms of moles of oxide/mole $Al_2O_3$ was:

$SiO_2$: 20
$Al_2O_3$: 1
$(Me_4N)_2O$: 0.9
$K_2O$: 7.1
$Fe(NH_4)_2(SO_4)_2$: 0.94
$H_2O$: 430

This total gel was then heated under quiescent conditions at ~95° C. Crystallizaiton was complete in 9 days, after which the product crystals were filtered out of solution and the product washed 3 times by boiling in water for 1 hour each washing, followed by filtration.

This product was found to have the molar composition with $Al_2O_3$ taken conventionally as 1.0:

$Al_2O_3$: =1.0
$SiO_2$: =13.3
$K_2O/Al_2O_3$: =0.59
Fe/Al: =0.39
$TMA_2O/Al_2O_3$: =0.75

NOTE: the water content was not determined.

X-ray analysis of the crystalline product showed the crystals to have the diffraction pattern substantially as listed in Table II.

Scanning electron microscopy of this product indicated that the approximate average particle size was about 0.1 micron.

The adsorption capacity of the product from Example B was found to be 4.6 weight percent cyclohexane at 20 mmHg and 20° C. This adsorption capacity was found to vary considerably from batch to batch from 4.6 to 8.0 weight percent, even though there was no significant difference in particle size or chemical composition of the products.

Typically these products were ammonium exchanged in 400 g/L ammonium nitrate aqueous solution for 16 hours under stirred, reflux conditions. The product was washed free of nitrate and had the chemical composition in moles with $Al_2O_3$ as 1.0 as follows:

$SiO_2Al_2O_3$: 13.6
$K_2O/Al_2O_3$: 0.39
Fe/Al: 0.39

The cyclohexane adsorption capacity at 20 mmHg and 20° C. was 7.1 weight percent.

It should be understood that the x-ray diffraction pattern of Table II is characteristic of all the species of T-IOZ-5 compositions, including those wherein the alkali or alkaline earth metals have been exchanged with another cation or cations. The exchanged offretite and T-IOZ-5 compositions have substantially the same x-ray diffraction pattern as set forth in Tables I and II for synthetic offretite and T-IOZ-5, respectively.

EXAMPLE 1

In an illustration of the current invention a synthetic offretite prepared as described previously (Example A) was washed by boiling in water for 1 hour, separating the solid from wash water and repeating this washing sequence three additonal times. The solid was then dried at 120° C., calcined in air at 450° C., 550° C. and 600° C. for 1 hour at each temperature. This solid was ion exchanged by refluxing for 2 hours with 0.5M ammonium nitrate, washed free of nitrate and dried at 120° C.

This base was loaded with platinum at room temperature by adding a solution of platinum tetraamine dichloride, containing enough platinum to give 0.5 weight percent loading on the catalyst, to an aqueous slurry of the zeolite. The platinum was added dropwise to the zeolite slurry over an 8 hour period, during which the slurry was stirred slowly. Stirring was continued for a further 16 hours after the addition was completed.

The catalyst so formed (catalyst A, Table III) was separated form the liquid and dried at 120° C. The catalyst so formed was pelletized in a 1 inch diameter die, at 24,000 pounds ram pressure. The resultant catalyst pellet was broken and sized between 14 and 20 mesh sieves (Tyler).

The catalyst tested for isomerization activity as follows. It was typicaly calcined in air at 400°-600° C. before loading into a reactor. The catalyst was then heated to 100°-150° C. and held at that temperature for 1 hour under a large excess of flowing hydrogen (typically 100 mls/5 gram catalyst). The temperature was then increased to ~400° C. over a ~0.75 hour time period and held there for 1 hour, after which the temperature was lowered to 250° C. before introduction of feed.

Table III illustrates the use of catalyst A to isomerize n-hexane (octane No. ~26) to a mixture of $C_5$ and $C_6$ isomers, the octane of which is 73.2, where the octane number is calculated according to the procedure defined in P. C. Anderson, J. M. Sharkey and R. P. Walsh, *J. Institute Petr.*, 58, 83 (1972).

TABLE III

| | Feed: n-hexane (Octane No. ~26) | | | | | | |
|---|---|---|---|---|---|---|---|
| Example No. | 1 | 2 | 3 | 4 | 5 | 6 | 7 |
| Catalyst | A | B | C | D | E | F | G |
| $SiO_2/Al_2O_3$ Ratio | 10 | 10 | 6 | 14 | 16.5 | 29 | 30 |
| Particle Size (microns) | 1-2 | 1-2 | 0.2 | 0.2 | 1-2 | <0.1 | 1-2 |
| Metal/Content, wt % | Pt/0.5 | Pd/0.2 | | | Pt(0.5) | | |
| Operating Conditions (1) | | | | | | | |
| Temperature, °C. | 308 | 303 | 297 | 298 | 300 | 300 | 305 |
| Pressure, KPAG | 241 | 172 | 172 | 172 | 172 | 172 | 172 |
| Catalyst Age, Hours | 2.3 | 2.0 | 2.9 | 4.0 | 20.0 | 3.1 | 10.3 |
| Product Composition, wt % on Feed | | | | | | | |
| $C_1$-$C_3$ | 8.3 | 2.1 | 1.5 | 1.7 | 3.6 | 1.7 | 3.2 |
| $C_4$ | 5.6 | 0.8 | 0.7 | 0.6 | 1.4 | 0.8 | 1.8 |
| $C_5$+ | 86.4 | 97.5 | 97.8 | 97.7 | 95.0 | 97.7 | 95.1 |
| $C_5$+ Octane | 73.2 | 70.2 | 67.8 | 72.4 | 70.0 | 69.6 | 69.8 |
| Composition of $C_6$ Fraction, wt % (2) | | | | | | | |
| n-$C_6$ | 23.2 | 25.9 | 29.6 | 23.6 | 18.8 | 26.8 | 26.8 |
| 3-$MC_5$ | 25.1 | 31.5 | 26.8 | 26.3 | 21.9 | 28.1 | 28.6 |
| 2-$MC_5$ + 2,3-$DMC_4$ | 46.1 | 37.5 | 37.9 | 36.2 | 46.8 | 38.6 | 38.5 |
| 2,2-$DMC_4$ | 5.6 | 5.1 | 5.7 | 13.9 | 17.5 | 6.5 | 6.2 |

(1) Other operating conditions: 1.0 W/Hr/W Space Velocity: 4:1 $H_2$:Feed Mole Ratio.
(2) Where n-$C_6$ = n-hexane $MC_5$ = methylpentane $DMC_4$ = dimethylbutane

EXAMPLE 2

In a further illustration of the current invention, the offretite base described in Example 1 was loaded with palladium (0.2 weight percent) in a manner similar to that described in Example 1 for platinum loading, except that the aqueous slurry of zeolite and the aqueous solution of palladium tetraamine dichloride were maintained at a pH of ~10.5 using aqueous ammonium hydroxide.

The catalyst so formed (catalyst B) was tested for activting to isomerize n-hexane after using the procedure described in Example 1 for activating and reducing the catalyst. Table III (above) illustrates the use of catalyst B to increase the octane of the feed by isomerization from 26 to 70.2.

EXAMPLE 3

A synthetic offretite was prepared as follows:

274.4 g of potassium hydroxide (85 wt% KOH) were dissolved in 800 g of distilled water, 46.8 g of alumina were then added and the slurry heated until the alumina dissolved. This solution was then added slowly with stirring to 1200 g Ludox LS over approximately a 10 minute period. This nucleation mixture was then allowed to age for 7 days. This slurry is denoted slurry A.

Figure 2:
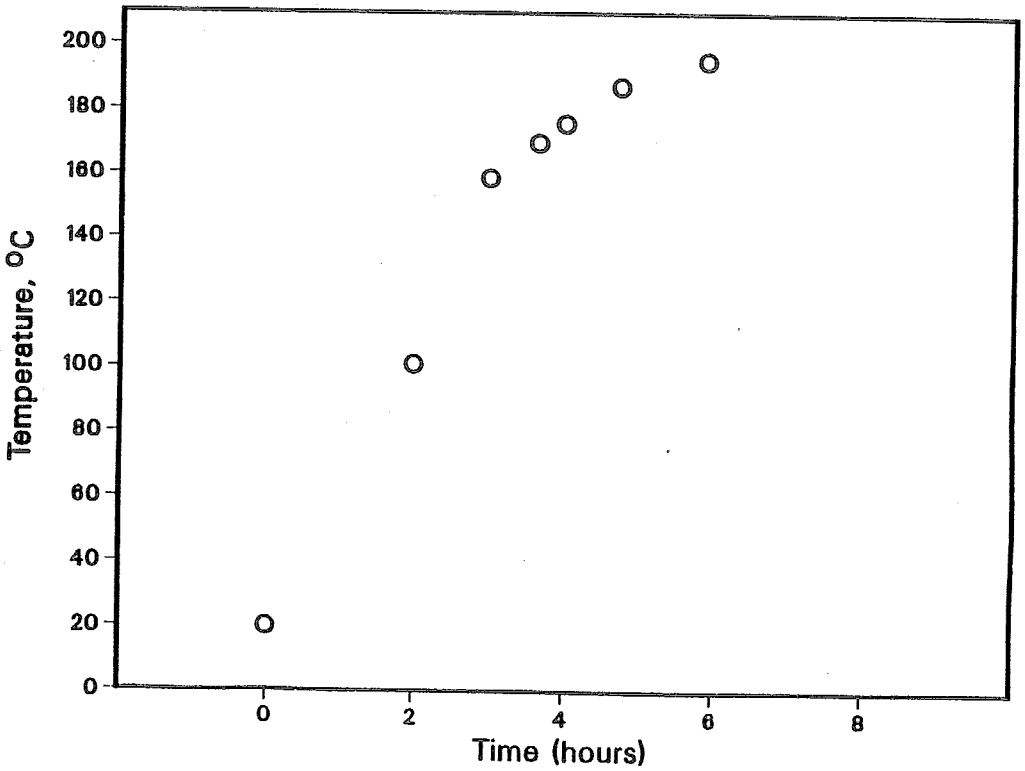
FIG. 2 presents a time/temperature profile during offretite synthesis of Example 3.

59.1 g tetramethyl ammonium chloride were dissolved in 375.9 g of distilled water and 224.1 g of n-butanol were mixed into this solution. This solution was then added slowly with stirring to a batch of slurry A. This total parent gel was then placed in a 1 gallon (US) autoclave which was heated, with stirring, according to the temperature/time profile shown in FIG. 2.

Crystallization was judged complete after 6 h. The crystalline solid so formed had the X-ray diffraction pattern shown in Table IV and was identified as an offretite.

TABLE IV

XRD PATTERN EXAMPLE 3

| 2 Times Theta | Relative* Intensity I/IO |
|---|---|
| 7.911 | 16.7 |
| 11.884 | 9.3 |
| 13.573 | 17.6 |
| 14.222 | 5.3 |
| 15.653 | 11.1 |
| 19.627 | 27.3 |
| 20.702 | 37.4 |
| 23.520 | 37.2 |
| 23.876 | 82.4 |
| 24.996 | 61.3 |
| 27.164 | 23.2 |
| 28.480 | 31.1 |
| 30.747 | 10.4 |
| 31.573 | 100.0 |
| 33.662 | 21.1 |
| 36.364 | 23.1 |

*Diffractometer fitted with automatic divergence slit.

The $SiO_2/Al_2/O_3$ ratio of the product was 6:1 as opposed to the 10:1 $SiO_2/Al_2O_3$ ratio of the product obtained in the absence of butanol and was also different in that the partical size as measured by scanning electron microscopy was 0.1 microns versus the 1–2 microns of the base case material prepared in Example 1.

A catalyst (catalyst C, Table III (above)) was formed from this material in a manner identical to that described in Example 1 and tested for n-hexane isomerization activity using the pretreatment and reduction conditions described in Table III. Table III illustrates the application of catalyst C for increasing the octane number of n-hexane from 26 to 67.8.

EXAMPLE 4

A synthetic offretite was prepared as follows:

274.4 g potassium hydroxide (85% KOH) were dissolved in 800 g distilled water of 46.8 g alumina were added and the slurry heated until the alumina dissolved. This was solution A.

Twenty grams of synthetic offretite as prepared from example 1 (as nucleation cites) was added to 1200 g Ludox LS and allowed to sit for ~21 days at room temperature. Solution A was then added slowly to this, with stirring over an approximate 10 min period. A solution of 81.5 tetramethylammonium chloride in 376 g distilled water was then added and this gel stirred until homogeneous. 224 g of n-butanol was then added and the gel again stirred until homogeneous. The total parent gel so formed was loaded into a 1 US gallon autoclave and stirred under autogeneous pressure at 100°–120° C. for about 90 h. The product so formed was identified as an offretite. This product was washed as described in Example 1 and had an X-ray diffraction pattern as shown in Table V.

TABLE V

XRD PATTERN OF EXAMPLE 4

| 2 Times Theta | Relative* Intensity I/IO |
|---|---|
| 7.600 | 11.3 |
| 11.644 | 6.9 |
| 13.298 | 20.8 |
| 15.404 | 7.3 |
| 19.360 | 16.1 |
| 20.418 | 33.1 |
| 23.591 | 73.7 |
| 24.747 | 39.5 |
| 26.862 | 20.0 |
| 28.187 | 23.5 |
| 30.480 | 11.7 |
| 31.289 | 100.0 |
| 33.360 | 20.1 |
| 36.018 | 22.5 |

*Diffractometer fitted with automatic divergence slit.

The washed product was calcined in air at 450°, 550° and 600° C. for 1 hr at each temperature and thereafter exchanged under reflux with 0.5M ammonium nitrate for 2 h. The solid so formed was washed and dried as described in Example 1 and loaded with platinum in a manner similar to that in Example 1, so that the final platinum level was 0.5 weight percent. The $SiO_2/Al_2O_3$ ratio of this catalyst (catalyst D) was 13:1 and the particle size was about 0.2 micron as measured by scanning electron microscopy.

This catalyst (catalyst D) was tested for n-hexane isomerization using the pretreatment and reduction conditions described in Example 1 and under the reaction conditions noted in Table III. Table III illustrates the application of catalyst D for increasing the octane number of n-hexane from 26 to 72.4 (contact time was about 6 seconds).

EXAMPLE 5

As a further illustration of the current invention, a synthetic offretite was prepared as described in Example A and washed as described in Example 1. The product was then calcined at 550° and 600° C. for 1 h at each temperature, in air. The product was then exchanged and dealuminated according to the procedure detailed in the literature (Kerr, G. T., *Phys. Chem.*, 72, 2594 (1968) but using the following steps:

exchange 0.5M ammonium nitrate under reflux, 2 h;
delumination (23 g EDTA-$H_4$/100 g zeolite) during which the EDTA-$H_4$ was added slowly via soxhlet;
calcination at 450° and 500° C. h at each temperature;
delumination (38 g EDTA-$H_4$/100 g zeolite);
exchange 2M ammonium nitrate, reflux, 2 hr.

The zeolite so formed was washed free of nitrate, dried and loaded with platinum to the 0.5 wt% level as described in example 1. This catalyst had a $SiO_2/Al_2O_3$ ratio of 16.5:1.

This catalyst (catalyst E) was tested for n-hexane isomerization using the pretreatment and reduction conditions described in Example 1 and under the reaction conditions noted in Table III. Table III illustrates the application of catalyst E to increase the octane number of a n-hexane stream from 26 to 70 by isomerization.

EXAMPLE 6

As further illustration of the current invention, an Fe-T-IOZ-5 zeolite was prepared as described previously (Example B) and washed as described in example 1. This product had the XRD pattern shown in Table VI.

TABLE VI

EXAMPLE 6

| 2 Times Theta | Relative* Intensity I/IO |
|---|---|
| 7.582 | 10.5 |
| 11.520 | 9.3 |
| 13.324 | 15.2 |
| 13.840 | 14.7 |
| 15.396 | 9.5 |
| 19.378 | 36.8 |
| 20.462 | 26.7 |
| 23.618 | 54.4 |
| 24.160 | 27.5 |
| 24.693 | 27.5 |
| 26.969 | 19.9 |
| 28.196 | 29.3 |
| 30.578 | 12.6 |
| 31.342 | 100.0 |
| 33.458 | 18.0 |
| 36.089 | 19.5 |

*Diffractometer fitted with automatic divergence slit.

This product was then treated as follows so as to remove iron from the crystal lattice:

calcined in air at 350°, 450°, 550°, and 600° C. for 1 h at each temperature;

iron/aluminum removal using EDTA-$H_4$ (16 g EDTA-$H_4$/100 g zeolite) and soxhlet/reflux via procedure described in example 5;

calcination at 550° C. for 1 hr. in air;

iron/aluminum removal using EDTA-$H_4$ (18 g EDTA-$H_4$/100 g zeolite);

calcination at 550° C., 1 hr. in air;

ion exchange with 0.5 ammonium nitrate or 2 hr. under reflux.

The material so obtained was washed free of nitrate as described in Example 1 and loaded with 0.5 wt% platinum as described in Example 1. This catalyst had a $SiO_2/Al_2O_3$ ratio of 29.0 and had <0.2 wt% iron.

This catalyst (catalyst F) was tested for n-hexane isomerization activity using the pretreatment and reduction conditions described in Example 1 under the reaction conditions noted in Table III (above). Table III illustrates the application of catalyst F to increase the octane number of a n-hexane stream from 26 to 69.6 via isomerization.

EXAMPLE 7

A further illustration of the current invention, a synthetic offretite was prepared as in Example A and washed as in Example 1. It was then exchanged and dealuminated using the techniques as described as in Example 5 as follows:

calcine at 550° C. for 2 h and 600° C. for 1 h in air;

dealuminate with EDTA-$H_4$ (47 g EDTA/100 g zeolite);

calcine 2 h in air at 550° C.;

dealuminate using EDTA-$H_4$ (20 g $EDTA_4$/100 g zeolite);

ion exchange in 0.55M ammonium nitrate under reflux.

The base so prepared was washed free of nitrate and loaded with 0.5 wt% platinum as described in example 1 to form catalyst G which had a $SIO_2/Al_2O_3$ of 30:1.

This catalyst (catalyst G) was tested for n-hexane isomerization activity after using the pretreatment and reduction conditions described in Example 1 and under the reaction conditions noted in Table III. Table III illustrates the application of catalyst G to increase the octane number of a n-hexane stream from 26 to 69.8 via isomerization.

EXAMPLE 8

As a further illustration of the current invention, a synthetic offretite was prepared as described in Example A and washed as described in example 1. The solid was dried at about 120° C. and calcined in air at 450° C. for 16 h, 550° C. for 2 h and 600° C. for 1 h. It was then dealuminated using the procedure in Example 5 as follows:

add 30 g EDTA-$H_4$/100 g zeolite slowly over a 24 h period to a slurry of a zeolite in water (>20:1 water to zeolite by weight) under reflux;

use a soxhlet to add EDTA-$H_4$;

continue reflux for further 24 h after EDTA-$H_4$ addition is complete;

boil wash as above, dry at 120° C.;

calcine 550° C. for 2 h;

ammonium exchange in 0.5M ammonium nitrate for 2,5 h under reflux;

repeat ammonium exchange for further 1 h.

The base so prepared was loaded with platinum to the 0.5 wt% level as described in Example 1 to form catalyst H which had a $SiO_2/Al_2O_3$ ratio of 12:1.

The catalyst (catalyst H) together with catalyst A and catalyst G were each tested for isomerization activity of a feedstock of composition 50 wt% 3-methyl-pentane and 50 wt% n-hexne. The catalysts in each case were treated as described in Example 1. Table VII illustrates the application of these catalysts for increasing the octane number of this feed from ~54 to >~72 in each case.

TABLE VII

| Catalyst | A | H | G |
|---|---|---|---|
| $SiO_2/Al_2O_3$ Ratio | 10 | 12 | 30 |
| Particle Size (microns) | 1–2 | 1–2 | 1–2 |
| Feed | 50/50 wt % 3MC5/nC6 (Octane No. ~54) | | |
| Operating Conditions (1) | | | |
| Temp. °C. | 303 | 297 | 299 |
| Space Velocity, w/w/hr | 0.4 | 1.0 | 1.1 |
| Catalyst Age (hrs) | 3.8 | 3.8 | 3.0 |
| Product Composition Wt % or Feed | | | |
| $C_1$–$C_3$ | 4.9 | 1.7 | 1.4 |
| $C_4$ | 2.0 | 0.9 | 0.8 |
| $C_5$+ | 93.3 | 97.5 | 97.9 |
| $C_5$+ Octane | 73.1 | 73.4 | 71.9 |
| Composition of $C_6$ Fraction wt % | | | |
| n-$C_6$ | 22.0 | 21.5 | 23.3 |
| 3-$MC_5$ | 28.6 | 28.1 | 30.2 |
| 2-$MC_5$ + 2,3$MC_4$ | 38.8 | 37.8 | 40.1 |

TABLE VII-continued

| Catalyst | A | H | G |
|---|---|---|---|
| 2,2DMC4 | 10.6 | 12.6 | 5.9 |

(1) Other Operating Conditions Total Pressure 172 KPAG 4:1 $H_2$:Feed Mole Ratio

EXAMPLE 9

Figure 3:
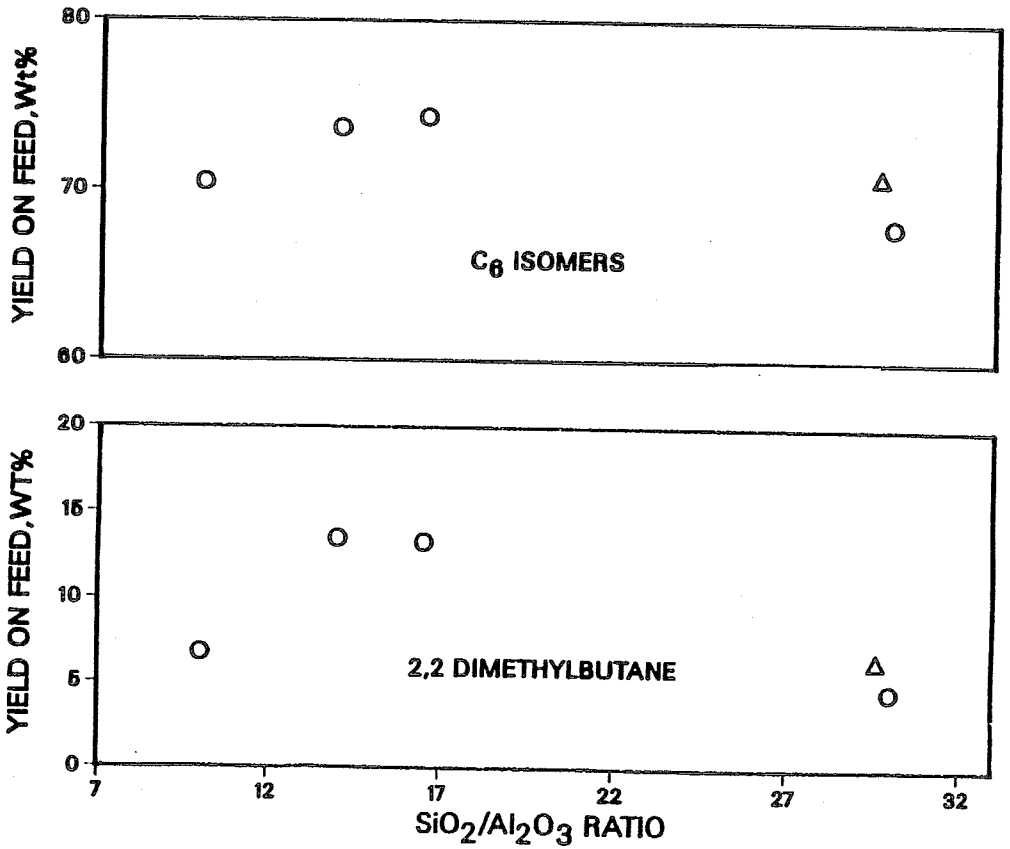
FIG. 3 compares yield on n-hexane feed of $C_6$ isomers and 2,2 dimethylbutane employing offretite and IOZ-5 zeolites of different $SiO_2/Al_2O_3$ ratios (Example 9).

This is an illustration of a preferred way of using the current invention. FIG. 3 shows the effect of $SiO_2/Al_2O_3$ ratio of the offretite base on the isomerization activity. This figure shows that the isomerization activity tends to maximize at $SiO_2/Al_2O_3$ of 15±1.

EXAMPLE 10

An example of a further preferred embodiment of the current invention is to operate under process conditions such that the contact time is optimized to give maximum yield and octane of isomerized product. Table VIII illustrates how this might be achieved by varying pressure.

TABLE VIII

Feed-n-hexane 0.5 wt % Pt on 30:1 $SiO_2/Al_2O_3$ Offretite

| | Catalyst G | |
|---|---|---|
| Operating Conditions | | |
| Temperature, °C. | 300 | 299 |
| Pressure, KPAG | 172 | 690 |
| Space Velocity, W/Hr/W | 1.0 | 1.0 |
| $H_2$/Feed, mole/mole | 4.2 | 4.2 |
| Contact Time, secs | 7.4 | 21.3 |
| Catalyst Age, Hours | 38.9 | 47.8 |
| Production Composition, wt % on Feed | | |
| $C_1$-$C_3$ | 2.0 | 1.6 |
| $C_4$ | 1.2 | 0.6 |
| $C_5$+ | 96.9 | 97.9 |
| n-$C_6$ Conversion (wt %) | 72.4 | 77.9 |
| Selectivity for i-$C_6$'S, wt % | 94.0 | 96.1 |
| $C_5$+ Octane | 72.4 | 77.9 |
| Composition of $C_6$ Fraction, wt % | | |
| n-$C_5$ | 28.9 | 23.0 |
| 3-$MC_5$ | 27.9 | 28.7 |
| 2-$MC_5$ + 2,3-$DMC_4$ | 38.5 | 36.7 |
| 2,2-$DMC_4$ | 4.7 | 11.7 |

By increasing the pressure from 172 to 690 KPaG, the contact time is increased from 7.4 to 21.3 sec. Contact time is defined as:

$$\text{Contact Time (sec)} = \frac{3600 \times FMW \times P}{1206 \times T \times CD \times WHSV \times (H_2\text{: Oil} + 1)}$$

where:

FMW=Average molecular weight of the feed
P=Pressure, psia
T=Temperature K.
CD=Catalyst bulk density, g/cc
$H_2$:Oil=Hydrogen to liquid feed ratio in moles
WHSV=Weight hourly space velocity, w/w/h The factor 3600 comes from converting hours to seconds and 1206 is the gas constant in $cm^3$.psia.gm mole.$-K-^1$.

This increases the $C_5$+ yield and the octane of the $C_5$+ product from 72.4 to 77.9.

EXAMPLE 11

This illustrates a further preferred embodiment of the current invention which is to tailor the particle size of the zeolite to maximize the $C_5$+ yield of the product. Table IX illustrates that decreasing the particle size from ~1.5 microns to <0.1 microns results in a $C_5$+ yield credit of 2.6 wt%.

TABLE IX

Feed-n-hexane

| Catalyst | G | F |
|---|---|---|
| $SiO_2/Al_2O_3$ | 30 | 29 |
| Particle Size (microns) | 1-2 | <0.1 |
| Temperature, °C.(1) | 305 | 300 |
| Catalyst Age, Hours | 10.3 | 3.1 |
| Product Composition, wt % on Feed | | |
| $C_1$-$C_3$ | 3.2 | 1.7 |
| $C_4$ | 1.8 | 0.7 |
| $C_5$+ | 95.1 | 97.7 |
| n-$C_6$ Conversion (wt %) | 75.0 | 74.0 |
| Selectivity for i-$C_6$, wt % | 91.3 | 96.1 |
| $C_5$+ Octane | 69.8 | 69.6 |
| Composition of $C_6$ Fraction, Wt % | | |
| n-$C_6$ | 26.8 | 26.8 |
| 3-$MC_5$ | 28.6 | 28.1 |
| 2-$MC_5$ + 2,3 $DMC_4$ | 38.5 | 38.6 |
| 2,2-$DMC_4$ | 6.2 | 6.5 |

(1)*Other operating conditions: Space Velocity = 1.0 W/Hr/W. Pressure = 172 kPag,* $H_2$:feed = 4:1 mole/mole.

EXAMPLE 12

In a further illustration of the current invention, offretite was synthesized from the $K_2O/Al_2O_3/SiO_2$tetramethylammonium chloride system as previously described in Example A. The $SiO_2/Al_2O_3$ ratio of the base was then increased by dealumination using the procedure detailed in Example 5 as follows:

(A) Wash the "as prepared" base in boiling water by boiling for 1 hour, then centrifuge off the wash water. Repeat four times;
Dry at 120° C. overnight;
(B) Calcine at 450°, 550° and 600° C. for 1 hour at each temperature.
(C) Add 30 g EDTA-$H_4$/100 g zeolite slowly, over a 25 hour period to a stirring slurry of the zeolite in water (>20:1 water to zeolite by weight) under reflux.
(D) Boil wash as in Item A, above;
Repeat four times;
Dry at 120° C. overnight;
(E) Calcine at 450°, 550° and 600° C. for 1 hour at each temperature.
(F) Exchange with ammonium nitrate (2M) for 2 hours under reflux (>20:1 nitrate solution:zeolite by weight).
Wash free of nitrate (until wash water is >1.0 ppm nitrate).

The base so prepared had the oxide formula (in moles of oxide, dry) as follows:

$$(0.75NH_4+0.25K)_2O.Al_2O_3.(16.0\pm0.5)SiO_2$$

This base was loaded with platinum to the 0.5 wt% level as described in Example 1. This catalyst (catalyst I) differed from catalyst E in that it had a better dispersion of platinum which in turn gave a more active catalyst as illustrated in Table X for isomerization of n-hexane.

TABLE X

Conditions: 1 w/w/h, 4:1 hydrogen to oil, 100 psig
Feed: n-hexane

| Catalyst | E | | I |
|---|---|---|---|
| Metal Surface Area ($m^2$/g) | | 65 | 165 |
| Avg. Reactor Temp. °C. | 280 | 300 | 280 |
| $C_5$+ Yield, wt % | 96.5 | 94.7 | 96.8 |
| Composition of $C_6$ | | | |

TABLE X-continued

| Conditions: 1 w/w/h, 4:1 hydrogen to oil, 100 psig Feed: n-hexane | | | |
|---|---|---|---|
| Catalyst | E | | I |
| Fraction, wt % | | | |
| n-$C_6$ | 23.03 | 18.8 | 19.4 |
| 3-$MC_5$ | 23.78 | 21.9 | 21.1 |
| 2-$MC_5$ | 36.05 | 32.6 | 32.1 |
| 2,3-$DMC_4$ | 8.25 | 8.8 | 8.2 |
| 2,2-$DMC_4$ | 9.13 | 17.5 | 17.1 |

EXAMPLE 13

The data in Table XI illustrates the utility of catalyst I for isomerization of a feedstock composed of 50/50 mole% ratio of n-pentane and n-hexane. The octance of the product has been increased to 78 versus the 42 octane number feedstock.

TABLE XI

| Operating Conditions: 1 w/w/h, 300° C.; 0.7 MPA, $H_2$/Oil = 4:1; time on stream 74 to 164 h Catalyst: Catalyst I Feed Composition: 50% mole ratio n-$C_5$/n-$C_6$ (RON CL = 42) | |
|---|---|
| $C_5$+ Yield, wt % | 92 |
| Composition of $C_5$ Fraction, wt % | |
| i$C_5$ | 65.2 (64–69)* |
| n$C_5$ | 34.8 |
| Composition of $C_6$ Fraction, wt % | |
| N-$C_6$ | 18.5 (18.6)* |
| 3-M-$C_5$ | 21.7 (21.4) |
| 2-M-$C_5$ | 32.6 (33.0) |
| 2,3-$DMC_4$ | 8.9 (8.6) |
| 2,2-$DMC_4$ | 18.3 (18.6) |
| RON CL (BP) | 78 |

*(Thermodynamic Equilibrium Values in Parenthesis)

EXAMPLE 14

This example illustrates the use of catalyst I to isomerize n-pentane under various process conditions shown in Table XII. In each case illustrated in Table XII, the octane of the product has been increased to >76 octane number versus the 62 octane number feedstock.

TABLE XII

| Feed: n-Pentane (Octane No. ~62) Catalyst: 0.5 wt % Pt on 16.5:1 $SiO_2/Al_2O_3$ offretite (catalyst I) | | | | | |
|---|---|---|---|---|---|
| Operating Conditions | | | | | |
| Temperature, °C. | 280 | 300 | 300 | 300 | 300 |
| Pressure, KPAG | 690 | 690 | 1724 | 1724 | 690 |
| Space Velocity, W/Hr/W | 1.0 | 1.0 | 1.0 | 1.0 | 1.0 |
| $H_2$/Feed, mole/mole | 4.0 | 4.0 | 4.0 | 6.0 | 6.0 |
| Product Composition, wt % on Feed | | | | | |
| $C_5$+ | 94.63 | 85.33 | 85.64 | 85.46 | 89.19 |
| $C_5$+ Octane | 76.2 | 78.5 | 77.9 | 77.6 | 78.4 |
| Composition of $C_5$ Fraction, wt % | | | | | |
| i-$C_5$ | 48.35 | 67.45 | 62.14 | 61.20 | 64.64 |
| n-$C_5$ | 51.65 | 32.55 | 37.86 | 38.80 | 35.36 |

EXAMPLE 15

An offretite was prepared and dealuminated as described in example 12. After ammonium exchange (item F, Example 12), the material so formed was dried at 120° 1 C., calcined at 600° C. for 2 hours in air and re-exchanged with ammonium nitrate as in Items E and F, example 12. This calcination/exchange may have to be repeated depending on the level of potassium exchange required. Using this technique, it was possible to exchange to the level illustrated below:

$$(0.93NH_4+0.07K)_2O.Al_2O_3.(16.0\pm0.5)SiO_2$$

This base was formed into catalyst J by loading with platinum to 0.5 wt% as described in Example 1.

Table XIII illustrates the application of this catalyst for isomerization of n-hexane under the conditions described in the table.

TABLE XIII

| Conditions: 0.7 MPAG, 4:1 $H_2$:Oil, 1 w/w/h, 280° C. Feed: n-hexane | |
|---|---|
| Catalyst | J |
| Loading Metal | 0.5 wt % Pt |
| Metal Surface Area, $m^2/g$ | 132 |
| Dispersion(1) | 51 |
| $C_5$+ Yield, wt % | 96.1 |
| Composition of $C_6$ Fraction, wt % | |
| n-$C_6$ | 20.0 |
| 3-m$C_5$ | 21.7 |
| 2-m$C_5$ | 33.0 |
| 2,3-$DMC_4$ | 8.4 |
| 2,2-$DMC_4$ | 16.9 |

(1)Calculated based on 100% dispersion for Pt = 260 $m^2/g$ as measured by carbon monoxide chemisorption

EXAMPLE 16

This example illustrates the application of catalyst J to isomerize a feedstock composed of 50 mole% n-pentane and 50 mole% n-hexane at different pressures. Table XIV shows that at each pressure substantial 2.2 dimethylbutane and i-pentane is formed from the feed which contained only normal paraffins.

EXAMPLE 17

Figure 4:
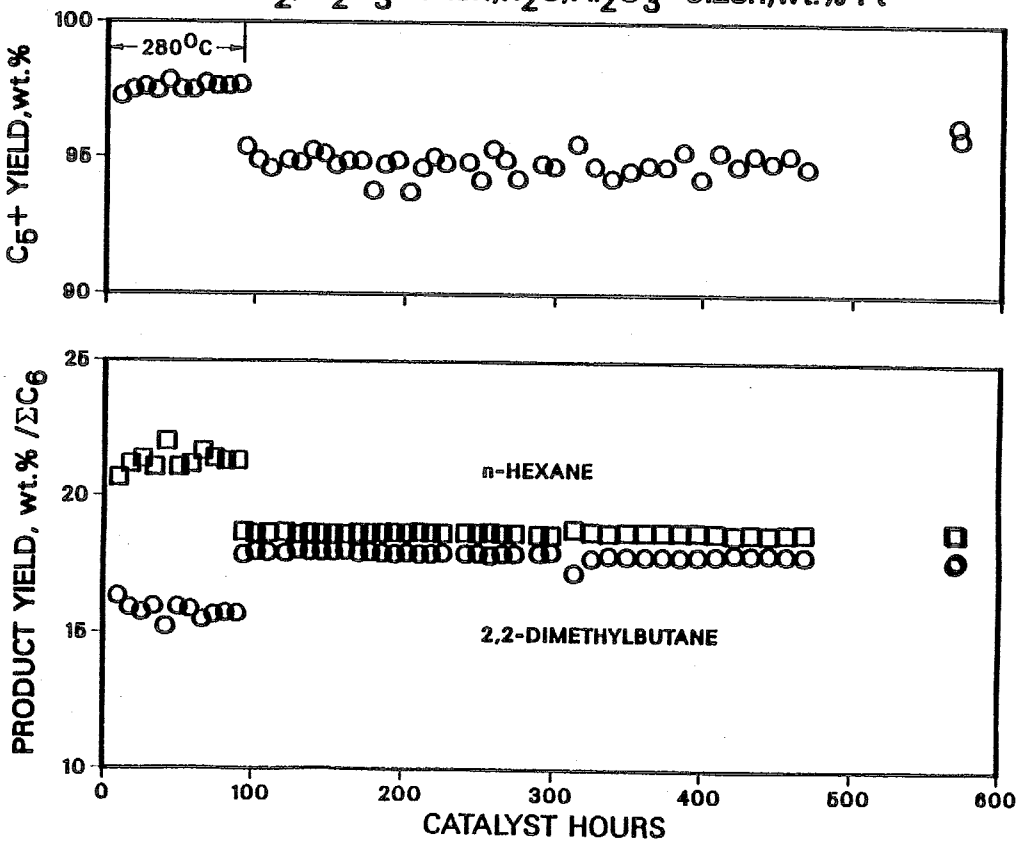
FIG. 4 presents activity maintenance of offretite catalyst ($SiO_2/Al_2O_3=16.5$, 0.5 weight percent Pt) at 300° C.

This example illustrates the repeat preparation and testing of catalyst I. This catalyst (catalyst K) was prepared according to the method described in example 12 and tested, for activity maintenance for isomerization of n-hexane under the conditions shown in FIG. 4. FIG. 4 shows that the catalyst again performed satisfactorily in terms of yields and steady operation over the course of the test.

EXAMPLE 18

This example describes a further repeat preparation of catalyst I and serves to illustrate the variability in metal dispersion with preparation and its effect on activity and activity maintenance of the catalyst for isomerization of n-hexane.

Figure 5:
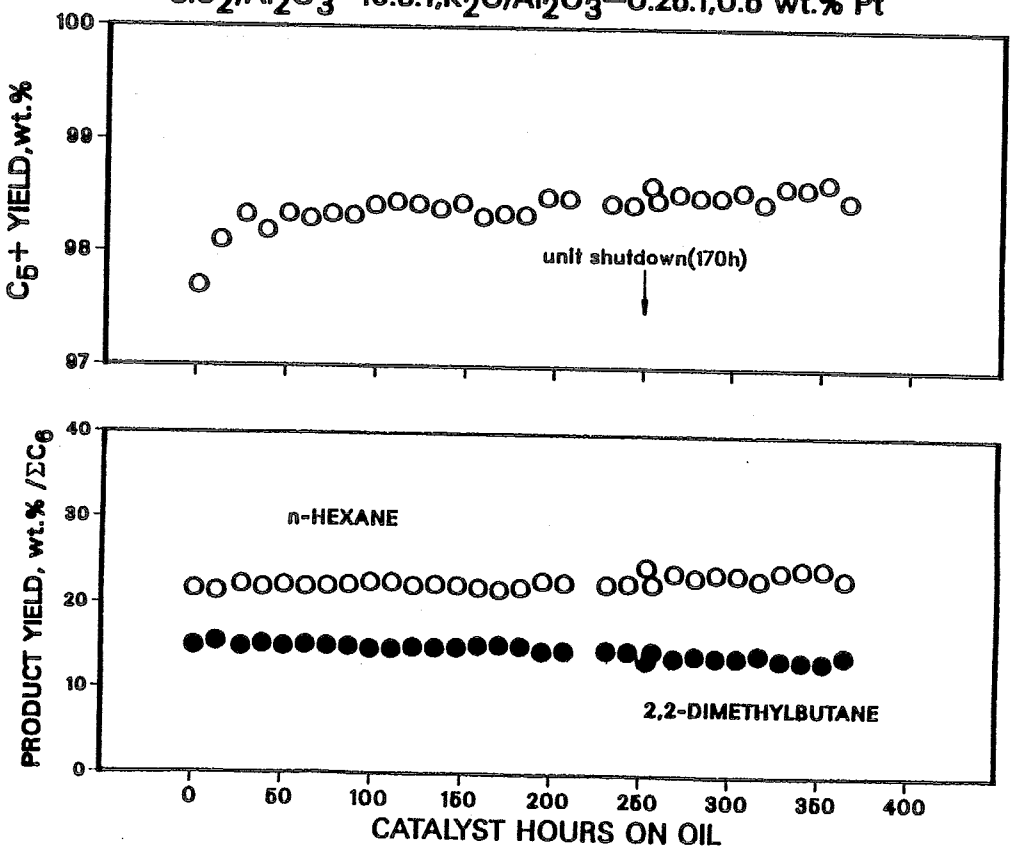
FIG. 5 presents activity maintenance of offretite catalyst ($SiO_2/Al_2O_3=16.5$, 0.5 weight percent Pt) at 280° C.

The zeolite and subsequent catalyst (catalyst L) were prepared a describe for catalyst I, example 12. The catalysts were identical except for metal surface area which was 165 $m^2/g$ in catalyst I but 60 $m^2/g$ in catalyst L. On testing catalyst L for activity for isomerization of n-hexane it did show acceptable activity (only ~1% less than that of catalyst I) and good activity maintenance as shown in FIG. 5. A further illustration of the flexibility of this catalyst is shown in FIG. 5 in that the testing unit was closed down after ~250 h on oil, the catalyst was allowed to sit idle for ~170 h at room temperature bottled up under hydrogen, and then brought back to operating temperature under flowing n-hexane and hydrogen (conditions as in FIG. 5). The FIG. 5 shows that the catalyst did not suffer any ill effect due to this shut down.

EXAMPLE 19

Figure 6:
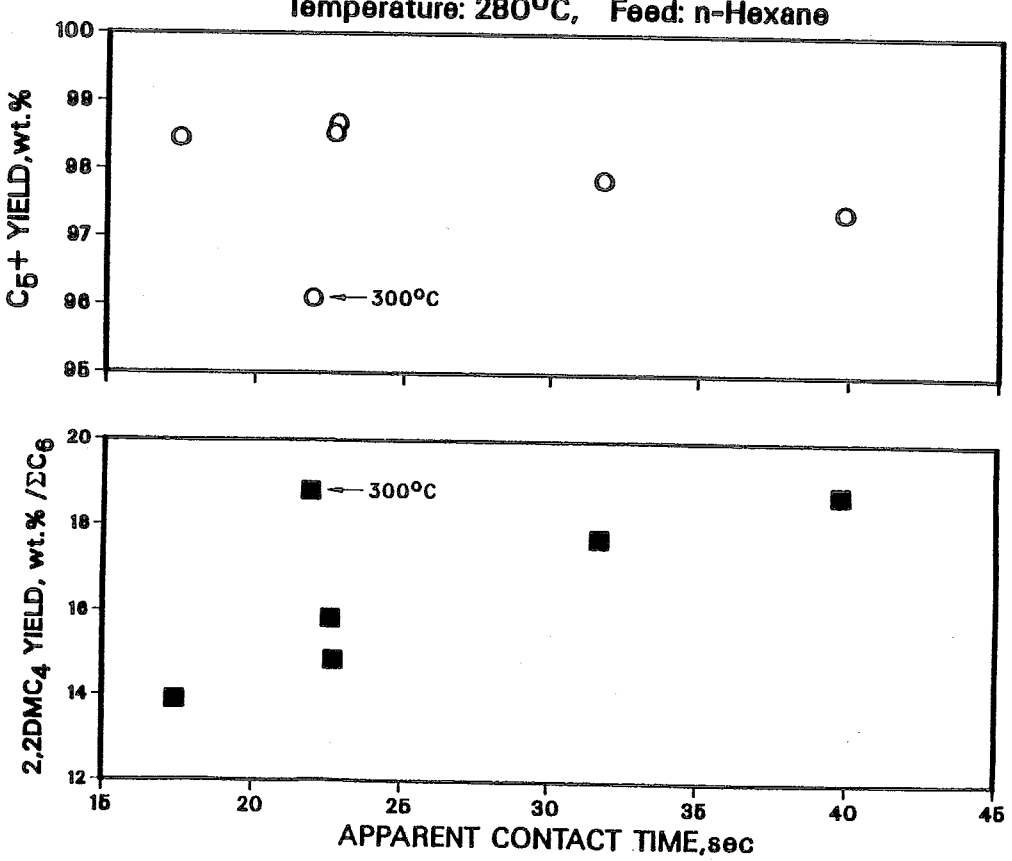
FIG. 6 presents the relationship between contact time of feed on catalysts to $C_5+$ and 2,2 $DMC_4$ product yield.

This is a further example of a preferred embodiment of the current invention, i.e. to operate under process conditions such that contact time is optimized to give maximum yield and/or octane of isomerized product. FIG. 6 illustrates (using Catalyst L) that by increasing contact time (as defined by equation in example 10) at constant temperature, the yield of 2.2 dimethylbutane increases (and hence the octane increases) but at the expense of some $C_5+$ yield, probably due to competing hydrocarbon reactions. A further way of increasing 2.2 dimethylbutane yield is to increase temperature at low contact time as illustrated in FIG. 6.

EXAMPLE 20

Figure 7:
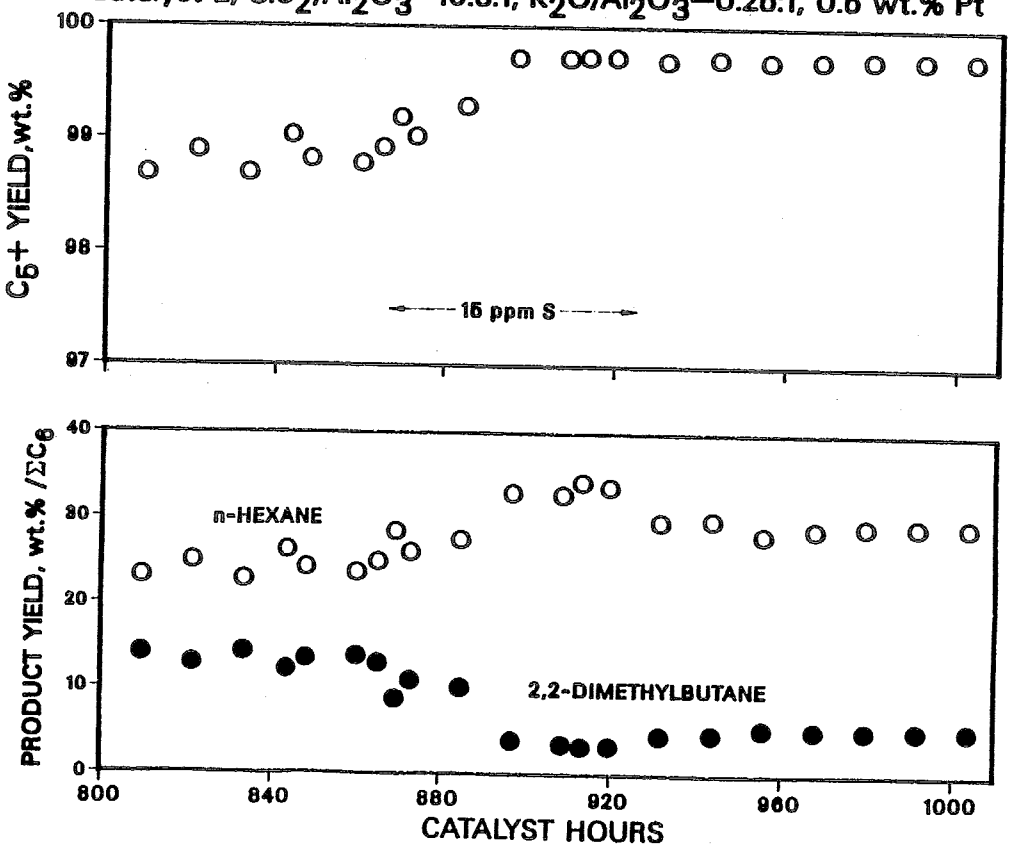
FIG. 7 presents the effect of sulfur (as ditertiary butylsulfide) in feed on catalyst activity for isomerization.
Figure 8:
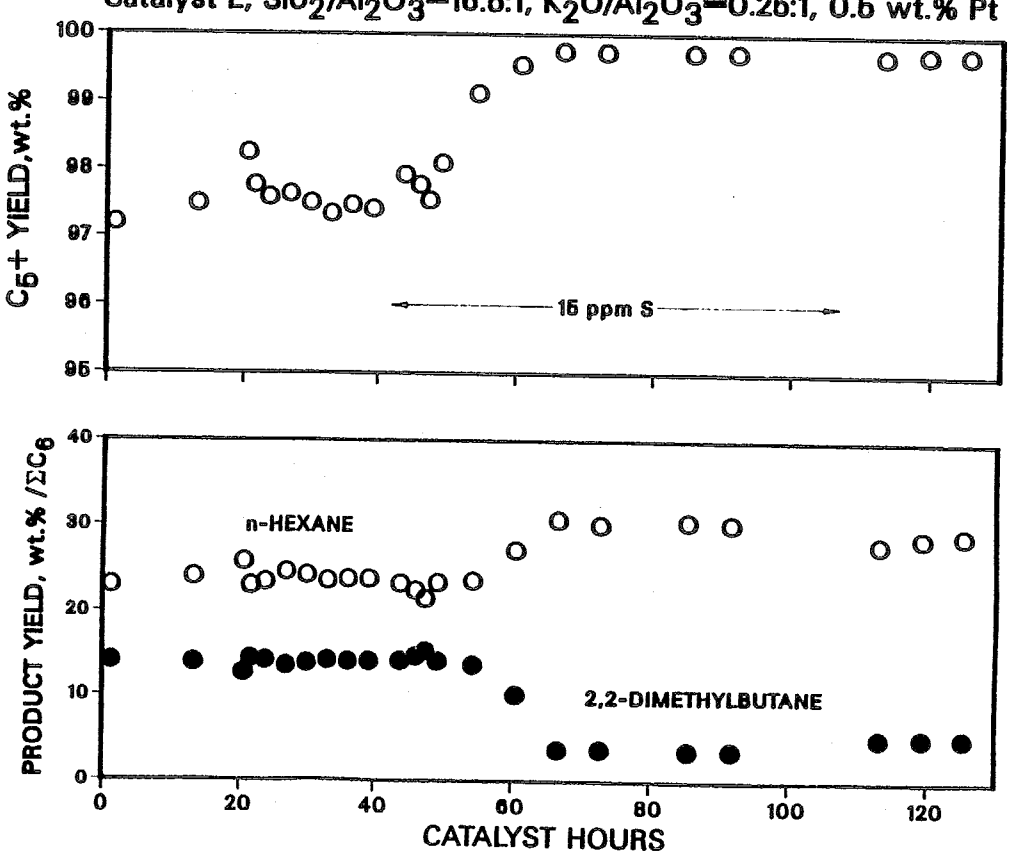
FIG. 8 presents the effect of sulfur (as dimethylsulphide) in feed on catalyst activity for isomerization.
Figure 9:
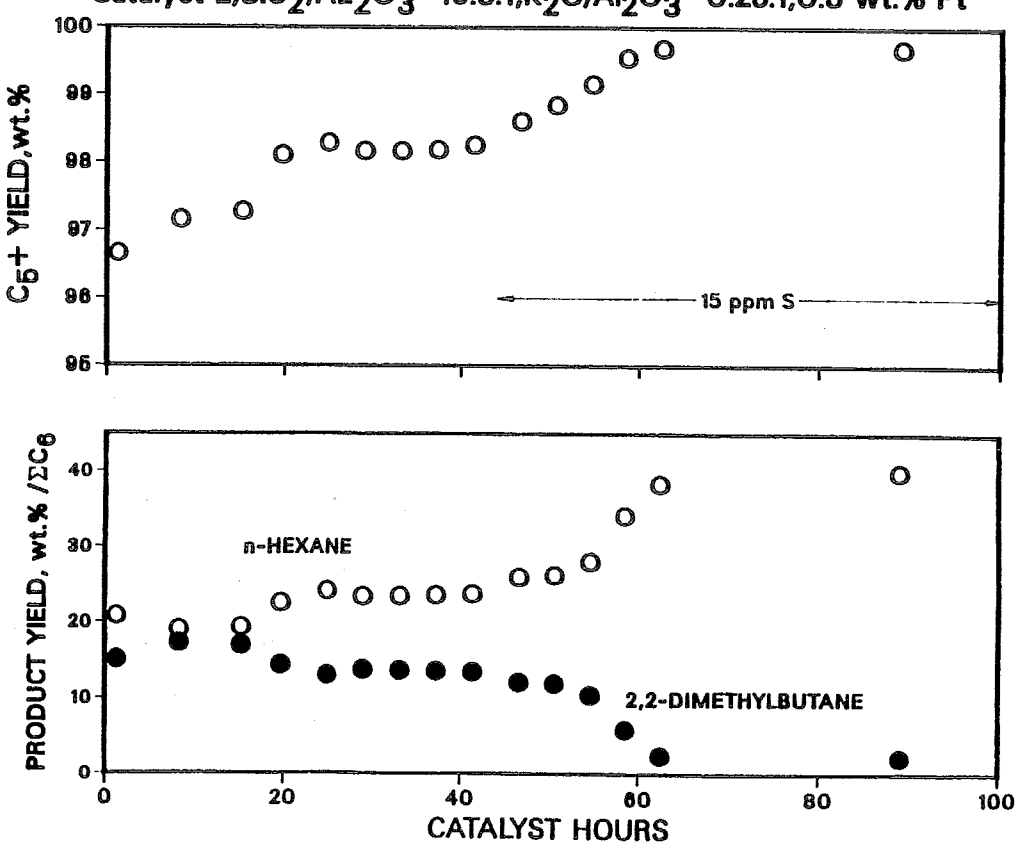
FIG. 9 presents the effect of sulfur (as thiophene) in feed on catalyst activity for isomerization.

This example illustrates a further preferred embodiment of the current invention. After ~850 h of steady operation isomerizing n-hexane, the feedstock over catalyst L was changed to n-hexane containing 15 ppm, sulphur as ditertiary-butylsulphide. FIG. 7 shows that this sulphur had a detrimental effect on the activity of catalyst L as shown by the sharp decrease in yield of 2.2-Dimethylbutane. To further illustrate this effect, a second sample of catalyst L was brought on stream under the conditions shown in FIG. 8 and the activity to isomerize n-hexane was established. After ~50 h on-stream the feedstock was changed to n-hexane containing 15 ppm sulphur as dimethylsulphide. FIG. 8 shows that again this had a detrimental effect on the isomerization activity of the catalyst as illustrated by the decrease in the yield of 2.2-Dimethylbutane. FIG. 9 illustrates a similar effect using 15 ppm sulphur as thiophene.

TABLE XIV

Feed: 50% mole ratio n-$C_5$/n-$C_6$
Operating Conditions: 300° C., 1 w/w/h, $H_2$/Oil = 4:1

| Pressure, psig | 25 | 160 |
|---|---|---|
| Catalyst | J | |
| $C_5+$ Yield, wt % | 94.7 | 91.8 |
| $C_5$ Yield, wt % | 45.1 (49.5*) | 45.0 (49.4*) |
| $C_6$ Yield, wt % | 49.6 (45.6*) | 46.8 (43.0*) |
| Composition of $C_5$ | | |

TABLE XIV-continued

Feed: 50% mole ratio n-$C_5$/n-$C_6$
Operating Conditions: 300° C., 1 w/w/h, $H_2$/Oil = 4:1

| Pressure, psig | 25 | 160 |
|---|---|---|
| Catalyst | J | |
| Fraction, wt % | | |
| i-$C_5$ | 67.6 | 64.5 |
| n-$C_5$ | 32.4 | 35.5 |
| Composition of $C_6$ Fraction, wt % | | |
| n-$C_6$ | 18.7 | 19.2 |
| 3-m$C_5$ | 21.8 | 22.0 |
| 2-m$C_5$ | 32.6 | 32.9 |
| 2,3-DM$C_4$ | 8.8 | 8.7 |
| 2,2-DM$C_4$ | 18.1 | 17.3 |

*Molar Yields.

What is claimed is:

1. A method for isomerizing naphtha feed said method comprising contacting the naphtha feed with an H-offretite catalyst having a silica/alumina ratio of about 12 to 17 in the presence of hydrogen at a temperature between 200° and 400° C., a pressure of about 14.7 to 1500 psig, a space velocity in the range of 0.05 to 75 V/V/hr and a hydrogen to feed ratio on a mole/mole basis in the range of 1:1 to 20:1.

2. The method of claim 1 wherein the catalyst is T-Z-5, T indicating a transition element from which the transition element has been leached from the zeolite framework.

3. The method of claim 1 wherein the offretite is in intimate combination with a hydrogenating component selected from the group consisting of tungsten, vanadium, molybdenum, rhenium, nickel, cobalt, chromium, manganese, platinum, palladium metal, oxide or sulfide, and mixtures thereof.

4. The method of claim 2 wherein the T-IOZ-5 is in intimate combination with a hydrogenating component selected from the group consisting of tungsten, vanadium, molybdenum, rhenium, nickel, cobalt, chromium, manganese, platinum, palladium metal, oxide or sulfide, and mixtures thereof.

5. The method of claim 1 wherein the naphtha feed contains less than about 100 ppm sulfur.

6. The method of claim 2 wherein the naphtha feed contains less than about 100 ppm sulfur.

7. The method of claim 1 wherein the naphtha feed contains less than about 15 ppm sulfur.

8. The method of claim 2 wherein the naphtha feed contains less than about 15 ppm sulphur.

* * * * *